US009643808B2

(12) United States Patent
Sato

(10) Patent No.: US 9,643,808 B2
(45) Date of Patent: May 9, 2017

(54) IMAGE FORMING APPARATUS WITH ACCELERATION/DECELERATION CONTROL

(71) Applicant: CANON KABUSHIKI KAISHA, Tokyo (JP)

(72) Inventor: Keita Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/644,794

(22) Filed: Mar. 11, 2015

(65) Prior Publication Data

US 2015/0261160 A1 Sep. 17, 2015

(30) Foreign Application Priority Data

Mar. 13, 2014 (JP) ..... 2014-050800

(51) Int. Cl.

| | |
|---|---|
| ***B65H 9/00*** | (2006.01) |
| ***G03G 15/00*** | (2006.01) |
| ***B65H 7/08*** | (2006.01) |
| ***B65H 7/02*** | (2006.01) |

(52) U.S. Cl.

CPC ..... *B65H 7/08* (2013.01); *B65H 7/02* (2013.01); *B65H 9/002* (2013.01); *G03G 15/6561* (2013.01); *G03G 15/6564* (2013.01); *G03G 15/6529* (2013.01); *G03G 2215/00945* (2013.01); *G03G 2215/0132* (2013.01)

(58) Field of Classification Search

CPC ..... G03G 15/6561; G03G 15/6564; G03G 2215/00599; G03G 2215/00945; B65H 7/08; B65H 9/00; B65H 9/002

See application file for complete search history.

(56) References Cited

U.S. PATENT DOCUMENTS

| | | | | |
|---|---|---|---|---|
| 2006/0269339 | A1* | 11/2006 | Okamoto et al. | 399/401 |
| 2008/0260444 | A1* | 10/2008 | Ikeda | G03G 15/6564 399/388 |
| 2010/0303530 | A1* | 12/2010 | Inoue | 399/396 |
| 2012/0072015 | A1* | 3/2012 | Takahashi | 700/229 |

FOREIGN PATENT DOCUMENTS

| | | | | |
|---|---|---|---|---|
| JP | 2008-287236 A | | 11/2008 | |
| JP | 2009132504 | * | 6/2009 | G03G 15/00 |

* cited by examiner

*Primary Examiner* — Blake A Tankersley

(74) *Attorney, Agent, or Firm* — Canon U.S.A., Inc. IP Division

(57) ABSTRACT

An image forming apparatus includes a sheet feeding unit, a detecting unit, and a control unit. The sheet feeding unit feeds a recording material. The detecting unit is disposed on a downstream side of the sheet feeding unit in a conveyance direction of the recording material and detects the recording material. The control unit controls the sheet feeding unit to feed the recording material at a speed. In a case where the sheet feeding unit is feeding the recording material at a first speed and the recording material has not been detected by the detecting unit before predetermined time elapses since the sheet feeding unit began feeding the recording material, the control unit controls the sheet feeding unit, before the recording material is detected by the detecting unit, to feed the recording material at a second speed that is higher than the first speed.

16 Claims, 8 Drawing Sheets

IMAGE FORMING APPARATUS WITH ACCELERATION/DECELERATION CONTROL

BACKGROUND OF THE INVENTION

1. Field of the Invention

The present invention relates to an electrophotographic image forming apparatus.

2. Description of the Related Art

An image forming apparatus that forms an image on a recording material by transferring an image formed on an image bearing member to a recording material in a transfer portion has been proposed. In such an image forming apparatus, the image formed on the image bearing member is conveyed in synchronization with timing at which a recording material reaches the transfer portion. The recording material is temporarily stopped by a registration roller before being conveyed to the transfer portion and is again conveyed in synchronization with the image formed on the image bearing member. Thus, the image can be transferred while the image and the recording material are aligned with each other.

In this manner, if the recording material is stopped temporarily by the registration roller, time necessary for the conveyance of the recording material is increased accordingly and, therefore, productivity (throughput) is reduced. Then, Japanese Patent Laid-Open No. 2008-287236 discloses a method for aligning a recording material and an image formed on an image bearing member without temporarily stopping the recording material by a registration roller. In particular, it is disclosed to perform acceleration and deceleration of the recording material so as to synchronize timing at which an image on an image bearing member reaches a transfer portion and timing at which a recording material reaches the transfer portion in accordance with time after the recording material is fed until a front end of the recording material is detected by a registration sensor.

By conveying the recording material to the transfer portion without temporarily stopping, not as in the related art, a sheet interval between a preceding sheet and a subsequent sheet can be shortened, and productivity can be improved. As another viewpoint of control in feeding the recording material, since recording materials with a high coefficient of friction, such as glossy paper (gross paper), have features that multi feeding are easy to occur, occurrence of multi feeding can be reduced by feeding at a lower sheet feeding speed. However, if the sheet feeding speed is lowered, time necessary to convey the recording material becomes longer. Then, it is considered to reduce a decrease in productivity by setting sheet feeding start timing earlier in a case in which the sheet feeding speed is lowered.

However, in order to set the sheet feeding start timing earlier, it is necessary to provide an image interval between an image formed on a preceding sheet and an image formed on a subsequent sheet so that the subsequent sheet does not contact the preceding sheet due to the earlier sheet feeding start timing of the subsequent sheet. It is possible to provide an enough sheet interval with which the subsequent sheet does not contact the preceding sheet by increasing an image interval to provide the image interval. However, there is a possibility that the sheet interval that has been shortened by conveying the recording material to the transfer portion without temporarily stopping, not as in the related art, should be increased, which causes a decrease in productivity.

SUMMARY OF THE INVENTION

According to an aspect of the present invention, an image forming apparatus includes a sheet feeding unit configured to feed a recording material, a detecting unit disposed on a downstream side of the sheet feeding unit in a conveyance direction of the recording material, and configured to detect the recording material, and a control unit configured to control the sheet feeding unit to feed the recording material at a speed, wherein, in a case where the sheet feeding unit is feeding the recording material at a first speed and the recording material has not been detected by the detecting unit before predetermined time elapses since the sheet feeding unit began feeding the recording material, the control unit controls the sheet feeding unit, before the recording material is detected by the detecting unit, to feed the recording material at a second speed that is higher than the first speed.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. It should be understood that the following embodiments do not limit the present invention related to the claims and not all the combinations of features described in the embodiments are necessary for the means for solving the problems.

First Embodiment

Figure 1:
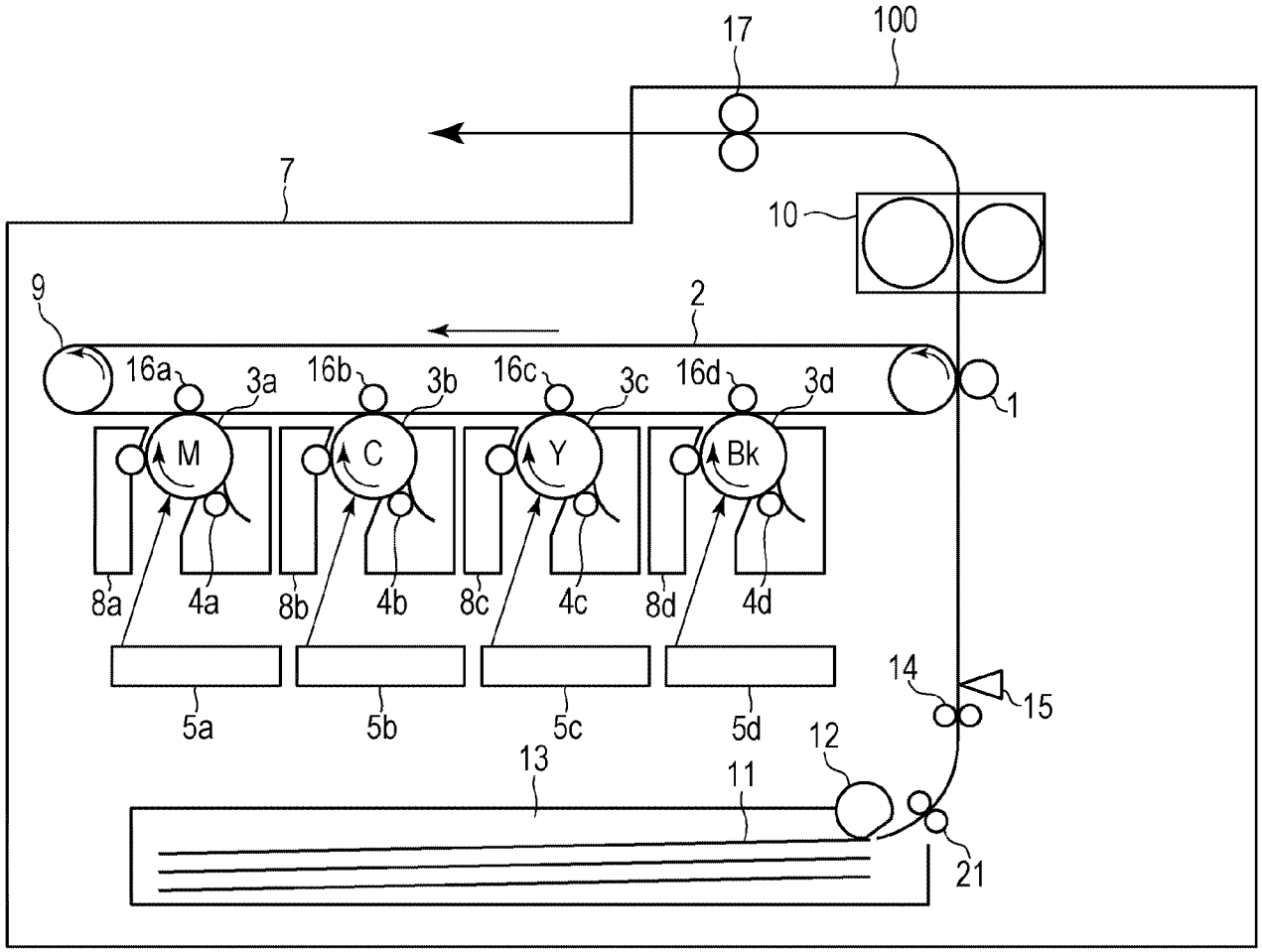
FIG. 1 is a schematic configuration diagram of an image forming apparatus of an intermediate transfer system.

FIG. 1 is a schematic configuration diagram of an image forming apparatus of an intermediate transfer system according to the present embodiment. English letters a, b, c and d attached to the reference numerals indicate that components denoted by the reference numerals relate to formation of toner images of yellow (Y), magenta (M), cyan (C), and black (Bk), respectively. If it is not necessary to distinguish colors in the following description, English letters a, b, c and d are not attached to the reference numerals.

An optical unit 5 forms an electrostatic latent image by irradiating a surface of a photoconductive drum 3 as a photosensitive member with a laser beam. Irradiation of the laser beam is referred also to as exposure. At this time, the photoconductive drum 3 is charged uniformly by a charging roller 4. The optical unit 5 controls irradiation timing of the laser beam so that an image is transferred at a predetermined position on a recording material 11 as a sheet of paper. The electrostatic latent image formed on the surface of the photoconductive drum 3 is visualized as a toner image with toner as a developer by a developing unit 8. The toner image formed on the photoconductive drum 3 is primarily transferred to an intermediate transfer belt 2 as an intermediate transfer member (i.e., to an intermediate transfer member) when primary transfer bias is applied to a primary transfer roller 16. When the toner image formed on the photoconductive drum 3 of each color is primarily transferred sequentially on the intermediate transfer belt 2, a color image is formed on the intermediate transfer belt 2. The color image formed on the intermediate transfer belt 2 is moved to a secondary transfer portion that consists of the intermediate transfer belt 2 and a secondary transfer roller 1 when the intermediate transfer belt 2 is driven by a driving roller 9.

The recording material 11 stacked on a paper cassette 13 is fed by a sheet feeding roller 12. If a plurality of recording materials 11 are fed, the recording materials 11 are separated one by one by a separation roller 21 and is conveyed. Then, the recording material 11 is conveyed by a registration roller 14, and a front end of the recording material 11 is detected by a registration sensor 15. In accordance with the timing at which the front end of the recording material 11 is detected by the registration sensor 15, a conveyance speed at which the recording material 11 is conveyed to the secondary transfer portion is controlled in synchronization with the timing at which the color image formed on the intermediate transfer belt 2 reaches the secondary transfer portion. The registration sensor 15 is disposed on the downstream side of the sheet feeding roller 12 in a conveyance direction of the recording material 11.

In the secondary transfer portion, when secondary transfer bias is applied to the secondary transfer roller 1, the color image formed on the intermediate transfer belt 2 is secondarily transferred to the recording material 11. The recording material 11 to which the color image is secondarily transferred is conveyed to a fixing unit 10 where the color image is heated and fixed. The recording material 11 to which the image is fixed is discharged to an output tray 7 by a discharge roller 17.

An image forming apparatus 100 is provided with a sheet feeding motor that drives the sheet feeding roller 12, the registration roller 14 and the separation roller 21, and an intermediate transfer belt driving motor that drives the secondary transfer roller 1 and the driving roller 9. The image forming apparatus 100 is further provided with a photoconductive drum driving motor that drives the photoconductive drum 3 and the primary transfer roller 16, and a fixing driving motor that drives a fixing roller. A sheet feeding motor can control a position and a speed, like a stepping motor. The sheet feeding motor is provided with a clutch mechanism that can transmit or interrupt driving force to the sheet feeding roller 12. When an operation of the clutch mechanism is started, feeding of the recording material 11 is started.

Figure 2:
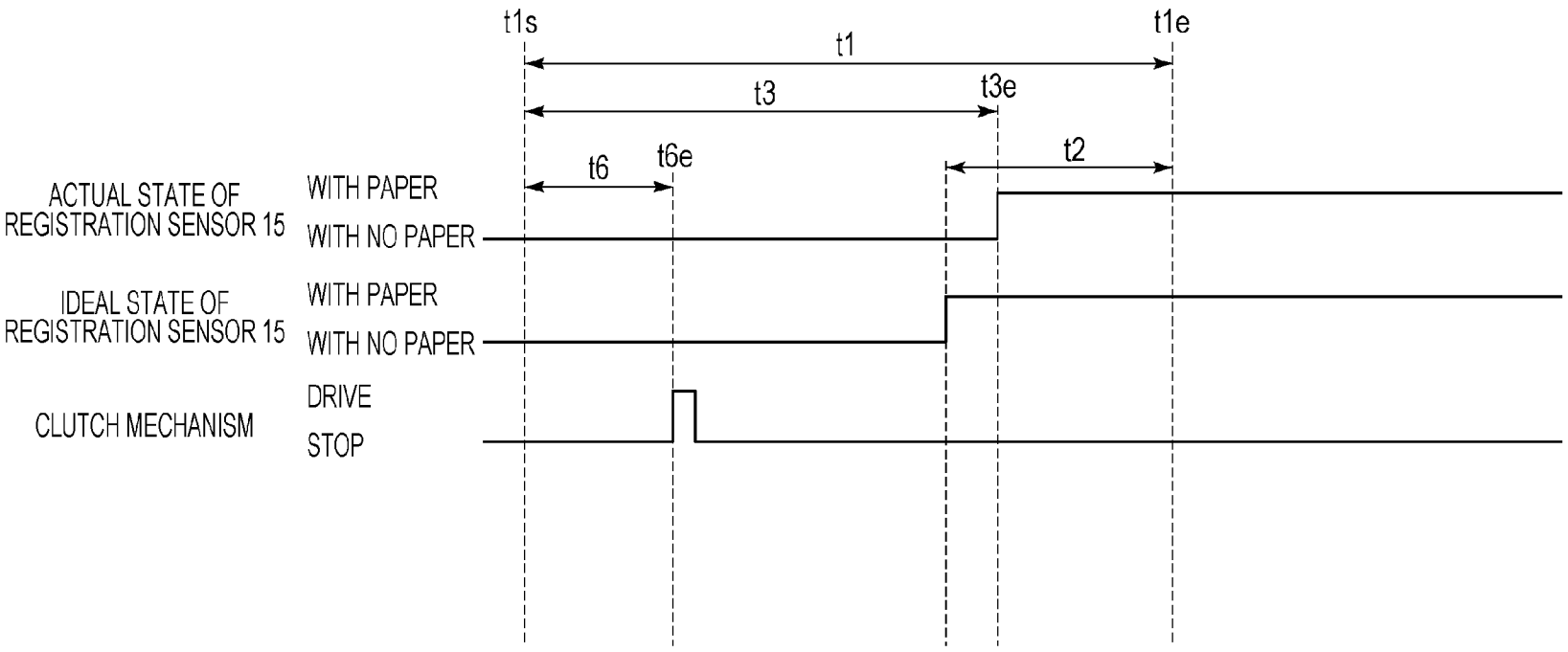
FIG. 2 is a timing chart illustrating time since formation of an electrostatic latent image is started until a toner image reaches a secondary transfer roller and a conveyance condition of a recording material.

FIG. 2 is a timing chart illustrating time since formation of the electrostatic latent image is started until the toner image reaches the secondary transfer roller 1 and a conveyance condition of the recording material 11. Timing t1*s* is exposure operation start timing at which an exposure operation to a photoconductive drum 3*a* is started by an optical unit 5*a*. The exposure operation start timing here is not necessarily only the timing at which exposure is started. For example, in a case in which exposure is performed in accordance with image data in which the front end of an image formation area is a margin and no electrostatic latent image is formed in that area, the front end of the image formation area is determined to be timing at which the exposure operation is started even if it is a margin. Timing tie is reaching timing at which the toner image formed on the intermediate transfer belt 2 reaches the secondary transfer portion. In a case in which the front end of the image formation area is a margin, as in the exposure operation start timing t1*s*, the reaching timing tie is the timing at which the front end of the image formation area reaches the secondary transfer portion even if the front end is a margin. Time t1 is time from the exposure operation start timing t1*s* to the reaching timing tie at which the toner image reaches the secondary transfer roller 1.

Timing t3*e* is detection timing at which the front end of the recording material 11 in the conveyance direction is detected by the registration sensor 15. Time t3 is actually measured time from the exposure operation start timing t1*s* to the detection timing t3*e* at which the front end of the recording material 11 in the conveyance direction is detected by the registration sensor 15. Time t2 is ideal time from the timing at which the front end of the recording material 11 in the conveyance direction is detected by the registration sensor 15 until the recording material 11 is conveyed to the secondary transfer portion. The ideal time here is the time when the recording material 11 is conveyed at a first speed (i.e., an image forming speed) from the registration sensor 15 to the secondary transfer portion. The image forming speed may be referred also to as a process speed. Timing t6*e* is sheet feeding start timing at which the clutch mechanism is operated and the recording material 11 is fed. Time t6 is time from the exposure operation start timing t1*s* to the sheet feeding start timing t6*e*.

Here, a specific conveyance condition of the recording material 11 is described as an example in the present embodiment. When feeding of the recording material 11 is started, the sheet feeding roller 12, the separation roller 21, and the registration roller 14 are driven at the first speed. The first speed here is, for example, a ⅓ speed, which the process speed at which an image is formed on a sheet of glossy paper (gross paper). The recording material 11 is conveyed at the first speed and made to reach the registration sensor 15. If the front end of the recording material 11 in the conveyance direction is not detected by the registration sensor 15 even after the recording material 11 is conveyed for predetermined time, the speed of the sheet feeding roller 12, the separation roller 21, and the registration roller 14 is switched to the second speed, which is higher than the first speed. The second speed here is, for example, 1/1 speed, which is the conveyance speed higher than the ⅓ speed. A method for obtaining the predetermined time is described in detail later.

When the front end of the recording material 11 in the conveyance direction is detected by the registration sensor 15, the conveyance speed of the recording material 11 is controlled to adjust conveying timing of the recording material 11 with respect to a position of the color image formed on the intermediate transfer belt 2. In particular, the conveyance speed of the recording material 11 is controlled using the following parameter: time t1 from the exposure operation start timing t1*s* to the reaching timing tie at which the toner image reaches the secondary transfer roller 1; the ideal time t2 from the timing at which the front end of the recording material 11 in the conveyance direction is detected by the registration sensor 15 until the recording material 11 is conveyed to the secondary transfer portion; and the actually measured time t3 from the exposure operation start timing t1*s* to the detection timing t3*e* at which the front end of the recording material 11 is detected by the registration sensor 15. From t1, t2 and t3, a temporal error (hereafter, simply referred to as an error) between timing at which the recording material 11 reaches the secondary transfer portion and timing at which the toner image on the intermediate transfer belt 2 reaches the secondary transfer portion is calculated as (t3−(t1−t2)). If the error is 0, the recording material 11 is aligned with the toner image at the secondary transfer portion if the recording material 11 is conveyed at the first speed without changing the speed. If the error is a positive value, the timing at which the recording material 11 reaches the registration sensor 15 is later than reference timing. In this case, the recording material 11 is controlled to accelerate so that the recording material 11 aligns with the toner image at the secondary transfer portion. If the error is a negative value, the timing at which the recording material 11 reaches the registration sensor 15 is earlier than the reference timing. In this case, the recording material 11 is controlled to decelerate so that the recording material 11 aligns with the toner image at the secondary transfer portion. The acceleration/deceleration control of the recording material 11 is described in detail later.

Figure 3:
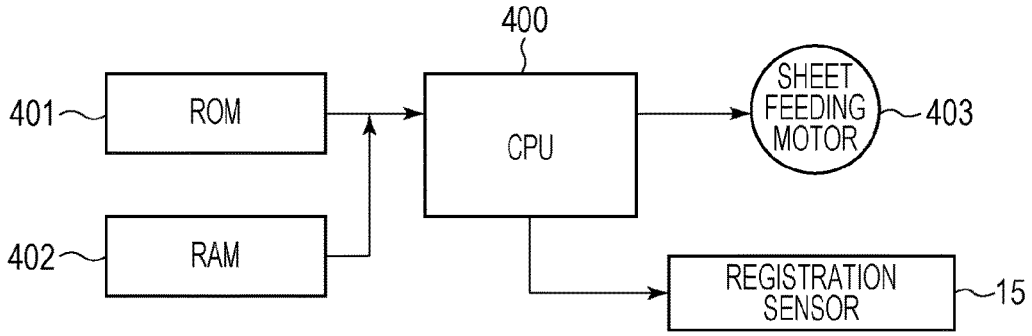
FIG. 3 is a control block diagram of an image forming apparatus.

FIG. 3 is a control block diagram of the image forming apparatus 100. A CPU 400 controls image formation in the image forming apparatus 100 using ROM 401 and RAM 402. In particular, the CPU 400 controls, for example, driving of a sheet feeding motor 403 that drives the registration roller 14, the sheet feeding roller 12, and the separation roller 21. The CPU 400 also controls detection timing of the registration sensor 15 that detects the front end of the recording material 11 in the conveyance direction, and receives an output value as a detection result.

Figure 4:
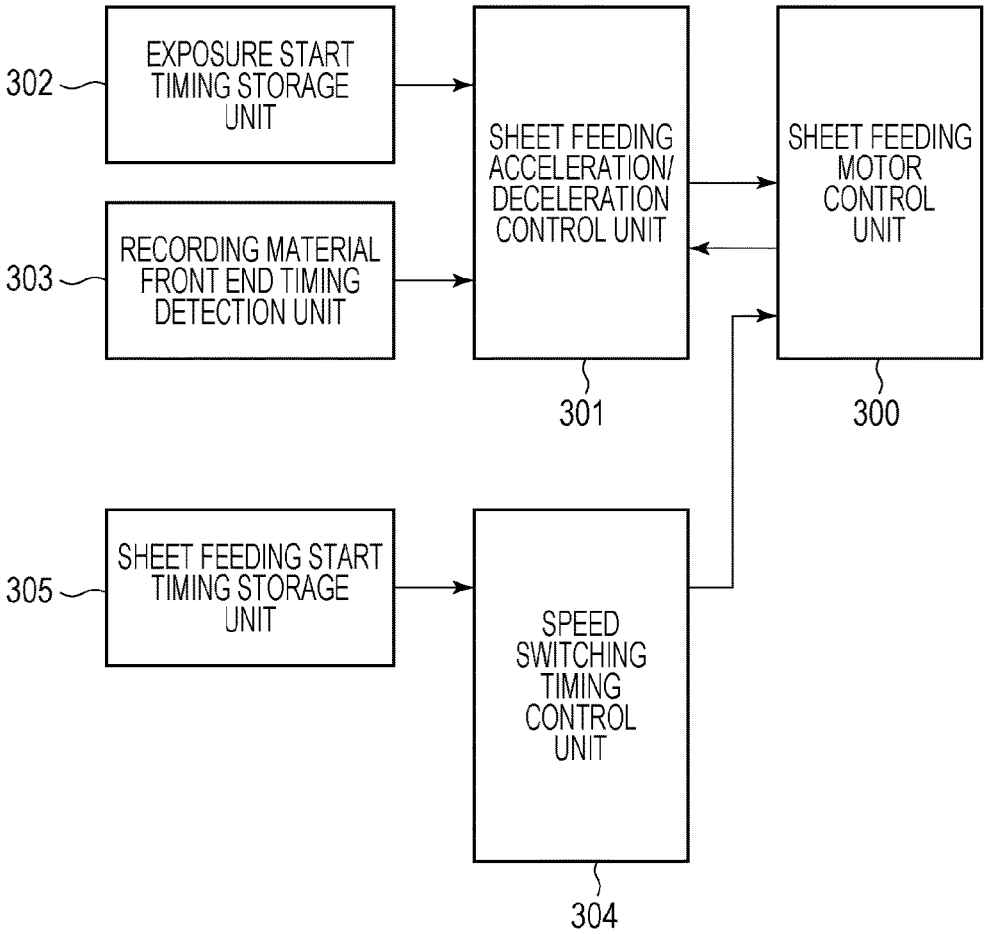
FIG. 4 is a functional block diagram of the image forming apparatus.

FIG. 4 is a functional block diagram of the image forming apparatus 100. FIG. 4 illustrates functions controlled by the CPU 400. Sheet feeding acceleration/deceleration control in the present embodiment is described with reference to the functional block diagram. The sheet feeding acceleration/deceleration control is performed by an exposure start timing storage unit 302, a recording material front end timing detection unit 303, a sheet feeding acceleration/deceleration control unit 301, a sheet feeding motor control unit 300, a speed switching timing control unit 304, and a sheet feeding start timing storage unit 305.

The exposure start timing storage unit 302 stores, in the RAM 402, the exposure operation start timing t1*s* at which the exposure operation to the photoconductive drum 3*a* is started by the optical unit 5*a*. The recording material front end timing detection unit 303 detects and stores, in the RAM 402, the detection timing t3*e* at which the front end of the recording material 11 in the conveyance direction is detected by the registration sensor 15. The sheet feeding start timing storage unit 305 stores, in the RAM 402, the sheet feeding start timing t6*e* at which the clutch mechanism is operated to feed the recording material 11. The speed switching timing control unit 304 switches the speed of the sheet feeding motor 403 from the first speed to the second speed when it detects that predetermined time has elapsed since the sheet feeding start timing t6*e* stored in the RAM 402. A method for obtaining the predetermined time is described in detail later.

Since the reaching timing tie at which the toner image formed on the intermediate transfer belt 2 reaches the secondary transfer portion can be calculated from the process speed at the time of image formation, the reaching timing tie is stored in the ROM 401 in advance for each process speed. The sheet feeding acceleration/deceleration control unit 301 calculates an acceleration amount or a deceleration amount of the sheet feeding motor 403 based on the exposure operation start timing t1*s* stored in the RAM 402, the detection timing t3*e*, and the driving speed of sheet feeding motor 403 obtained from the sheet feeding motor control unit 300. The sheet feeding motor control unit 300 performs acceleration/deceleration control of the sheet feeding motor 403 in accordance with the acceleration amount or the deceleration amount of the sheet feeding motor 403 calculated by the sheet feeding acceleration/deceleration control unit 301.

Figure 5:
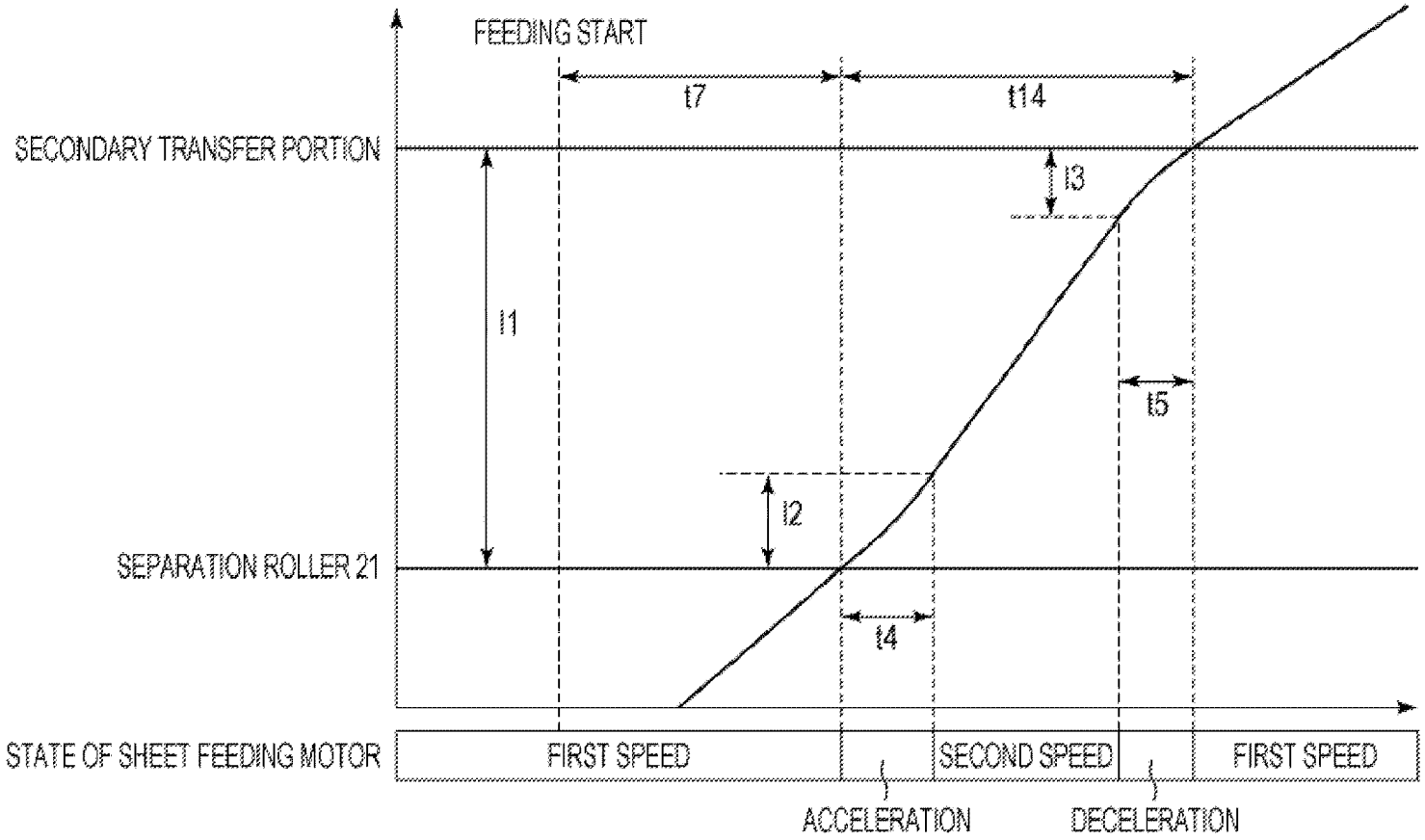
FIG. 5 is a diagram illustrating timing at which a sheet feeding motor is switched from a first speed to a second speed higher than the first speed.

Next, a method for obtaining the timing at which the speed of the sheet feeding motor 403 in the present embodiment is switched from the first speed to the second speed higher than the first speed is described with reference to FIG. 5. As an example of the acceleration/deceleration control in the present embodiment, a method for switching from the first speed to the second speed higher than the first speed is described. However, the acceleration/deceleration control is not limited to the same: depending on the situation, switching from the first speed to a third speed lower than the first speed, and switching from the first speed to a fourth speed still higher than the second speed may also be possible. That is, the conveyance speed may be switched from the first speed to any speed if, after the recording material 11 is fed at the first speed, the timing at which the recording material 11 reaches the secondary transfer portion synchronizes with the timing of the color image formed on the intermediate transfer belt 2.

In the present embodiment, when a sheet of glossy paper (gross paper), as a recording material 11 that easily causes multi feeding, is conveyed, the recording material 11 is conveyed at the first speed, which is a relatively low speed, until the recording material 11 reaches the separation roller 21 in order to reduce occurrence of multi feeding. After the recording material 11 reaches the separation roller 21, since a possibility of occurrence of multi feeding caused by an increase in the conveyance speed is reduced even if the recording material 11 is a sheet of glossy paper, the conveyance speed of the recording material 11 can be switched to the second speed that is higher than the first speed. Then, the shortest conveyance time t14 necessary to convey the recording material 11 from the separation roller 21 to the secondary transfer portion is first obtained by the following Expression (1):

$$t14=((l1-l2-l3)/v2)+t4+t5 \quad (1)$$

Parameters in Expression (1) are:

t4: time necessary to switch from the first speed to the second speed;

t5: time necessary to switch from the second speed to the first speed;

l1: distance from the separation roller 21 to the secondary transfer portion;

l2: distance necessary to change the conveyance speed from the first speed to the second speed;

l3: distance necessary to change the conveyance speed from the second speed to the first speed; and v2: the second speed.

Next, predetermined time t7, which is time since the recording material 11 is fed at the first speed until the speed is switched to the second speed is obtained by the following Expression (2) from the minimum conveyance time t14 obtained by Expression (1):

$$t7=(t1-t6)-t14 \quad (2).$$

Parameters in Expression (2) are:

t1: time from the exposure operation start timing t1*s* to the reaching timing tie at which the toner image reaches the secondary transfer roller 1; and t6: time from the exposure operation start timing t1*s* to the sheet feeding start timing t6*e*.

The timing at which the speed of the sheet feeding motor 403 is switched from the first speed to the second speed is obtained by Expressions (1) and (2). By switching the conveyance speed of the recording material 11 at this timing, even if the recording material 11 reaches the registration sensor 15 at the most delayed time, the conveyance of the recording material 11 can be in synchronization with the timing at which the toner image reaches the secondary transfer portion by performing the acceleration/deceleration control. In this manner, multi feeding of the recording material 11 can be reduced by setting the speed at which the recording material 11 is fed to the first speed, and switching the conveyance speed of the recording material 11 to the second speed when predetermined time elapses after the recording material 11 is fed. Further, since the conveyance speed of the recording material 11 is switched to the second speed when predetermined time elapses after the recording material 11 is fed, a sheet interval can be provided with which a subsequent sheet does not contact a preceding sheet without increasing an image interval between an image formed on the preceding sheet and an image formed on the subsequent sheet. Thus, a decrease in productivity can also be reduced.

Figure 7:
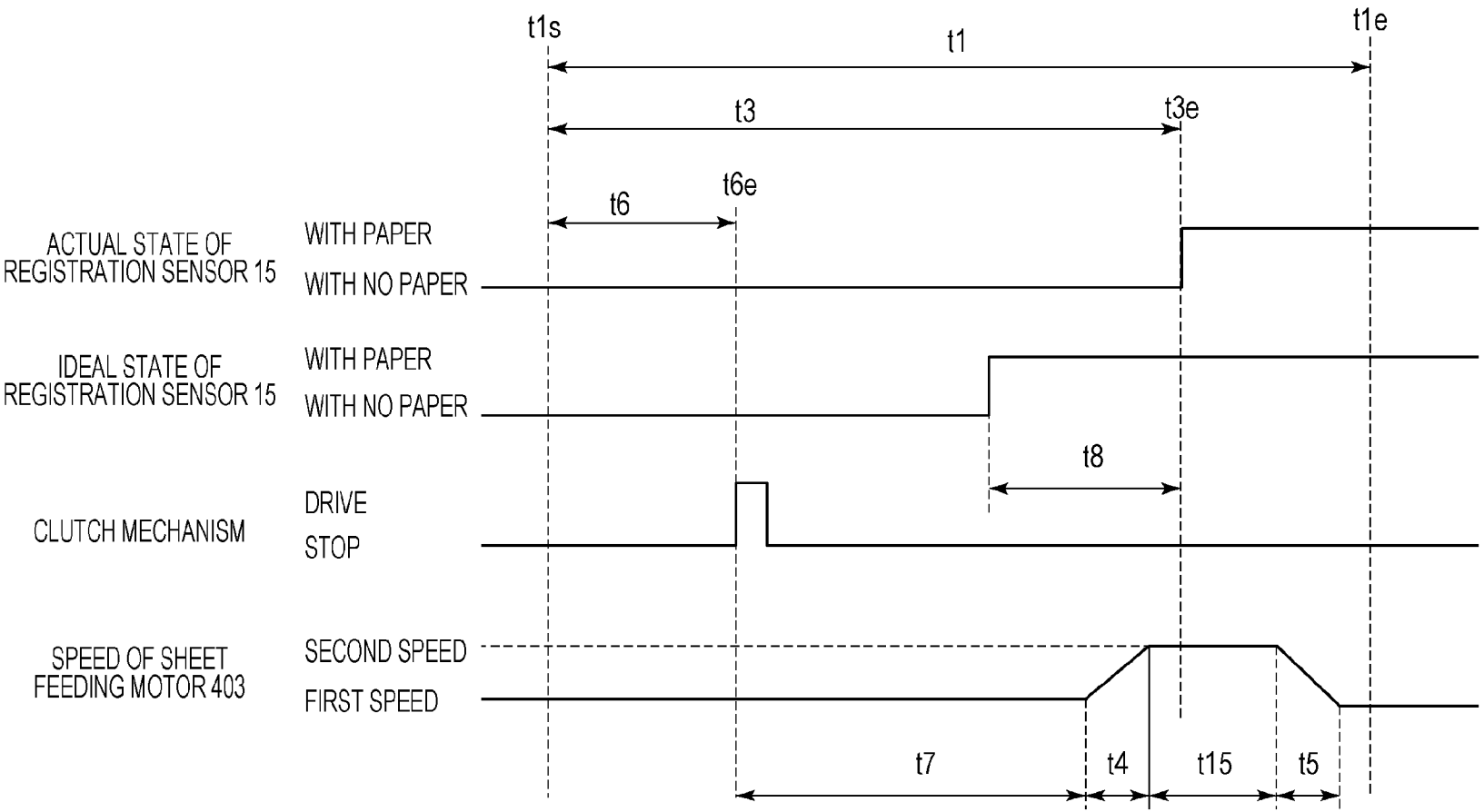
FIG. 7 is a timing chart illustrating a speed of the sheet feeding motor when the recording material reaches the registration sensor.
Figure 8:
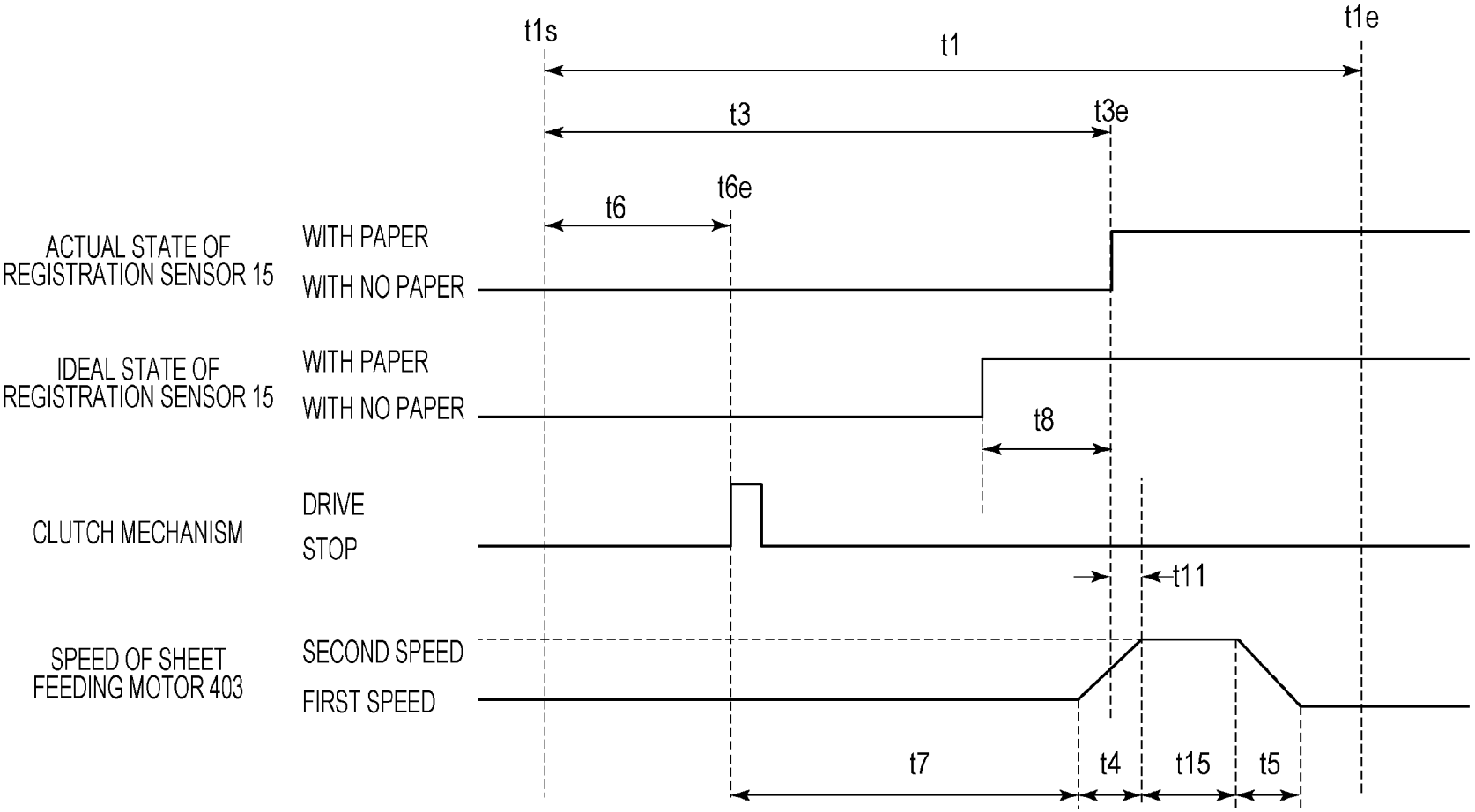
FIG. 8 is a timing chart illustrating a speed of the sheet feeding motor when the recording material reaches the registration sensor.

A method for performing acceleration/deceleration control of the recording material 11 in accordance with the timing at which the toner image formed on the intermediate transfer belt 2 reaches the secondary transfer portion in accordance with the timing at which the front end of the recording material 11 in the conveyance direction is detected by the registration sensor 15 in the present embodiment is described. Suppose that the speed at which the toner image is formed on the intermediate transfer belt 2 (i.e., the process speed) is the first speed. In the present embodiment, the speed of the sheet feeding motor 403 (i.e., the conveyance speed of the recording material 11) is switched from the first speed to the second speed when the predetermined time t7 elapses after feeding of the recording material 11 is started. Therefore, the speed of the sheet feeding motor 403 when the recording material 11 reaches the registration sensor 15 may be one of the following three speeds: the first speed (FIG. 6); the second speed (FIG. 7), and the speed during the transition from the first speed to the second speed (FIG. 8).

Figure 6:
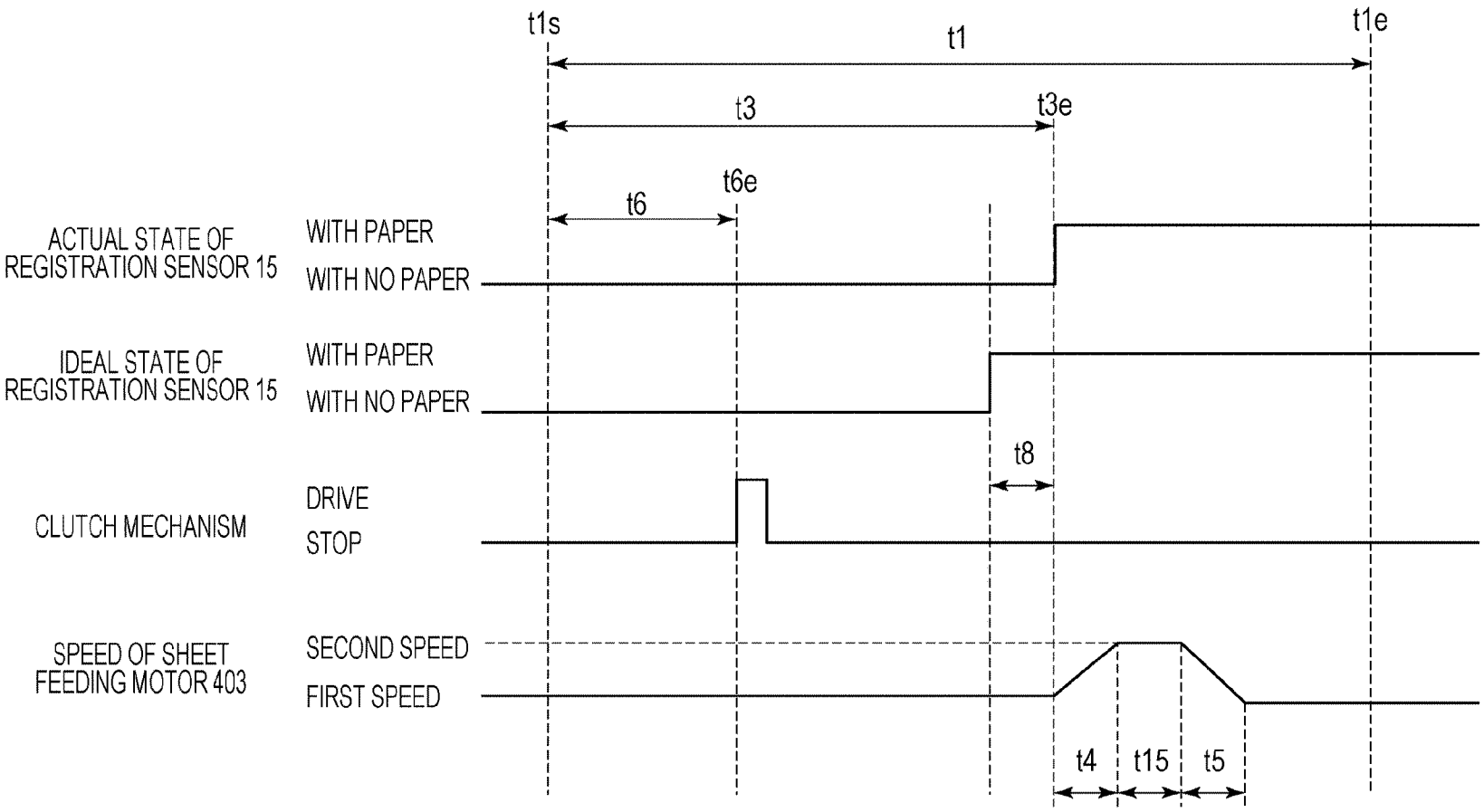
FIG. 6 is a timing chart illustrating a speed of the sheet feeding motor when a recording material reaches a registration sensor.

First, the acceleration/deceleration control in a case in which the front end of the recording material 11 in the conveyance direction is detected by the registration sensor 15 in a state in which the speed of the sheet feeding motor 403 is the first speed is described with reference to FIG. 6. If the timing at which the toner image formed on the intermediate transfer belt 2 reaches the secondary transfer portion and the timing at which the recording material 11 is conveyed at the first speed to the secondary transfer portion without changing the speed are in synchronization with each other, conveyance of the recording material 11 is continued without changing the speed. That is, if there is no error t8 between the toner image formed on the intermediate transfer belt 2 and the recording material 11 conveyed at the first speed, it may also considered that conveyance of the recording material 11 is continued at the first speed. The error t8 is obtained by comparing with the toner image formed on the intermediate transfer belt 2 as an example, the method for obtaining the error t8 is not limited to the same. For example, it is also possible to store reference timing (i.e., ideal timing) at which the recording material 11 reaches the registration sensor 15 and obtain the error t8 from a difference between the reference timing and the timing at which the recording material 11 actually reaches the registration sensor 15. If there is an error, time t15 for which the recording material 11 is conveyed at the second speed is obtained by the following Expression (3). The recording material 11 is conveyed at the second speed for the obtained t15. Then, the speed is decelerated to the first speed again and the recording material 11 is made to reach the secondary transfer portion.

$$t15=((t8-(((12+13)\times t9)-t4-t5))/(t9-t10))/v2 \quad (3)$$

Parameters in Expression (3) are:

t4: time necessary to switch from the first speed to the second speed;

t5: time necessary to switch from the second speed to the first speed;

l2: distance necessary to switch from the first speed to the second speed;

l3: distance necessary to switch from the second speed to the first speed;

t8: temporal error;

t9: time necessary to convey unit quantity of the recording material 11 at the first speed;

t10: time necessary to convey unit quantity of the recording material 11 at the second speed; and v2: the second speed.

Here, an example in which the speed is switched to the second speed if there is an error has been described, but this example is not restrictive. Depending on the error, if the timing at which the recording material 11 reaches the registration sensor 15 is late, for example, it is only necessary to switch to a speed higher than the first speed. If the timing at which the recording material 11 reaches the registration sensor 15 is early, it is only necessary to switch to a speed lower than the first speed. In that case, t15 according to each switched speed can be obtained by suitably changing the value of V2 indicating the second speed in Expression (3) into a switched speed depending on the switched speed.

Next, acceleration/deceleration control when the front end of the recording material 11 in the conveyance direction is detected by the registration sensor 15 in a state in which the speed of the sheet feeding motor 403 is the second speed is described with reference to FIG. 7. If the recording material 11 is detected by the registration sensor 15 when the recording material 11 is conveyed at the second speed, the time t15 for which the recording material 11 is conveyed at the second speed is obtained by the following Expression (4). The recording material 11 is conveyed at the second speed for the obtained t15. Then, the speed is decelerated to the first speed again and the recording material 11 is made to reach the secondary transfer portion.

$$t15=((t8-((13\times t9)-t5))/(t9-t10))/v2 \quad (4)$$

Parameters in Expression (4) are:

t5: time necessary to switch from the second speed to the first speed;

l3: distance necessary to switch from the second speed to the first speed;

t8: temporal error;

t9: time necessary to convey unit quantity of the recording material 11 at the first speed;

t10: time necessary to convey unit quantity of the recording material 11 at the second speed; and v2: the second speed.

The acceleration/deceleration control in a case in which the front end of the recording material 11 in the conveyance direction is detected by the registration sensor 15 when the speed of the sheet feeding motor 403 is being switched from the first speed to the second speed is described with reference to FIG. 8. In a case in which the recording material 11 is detected by the registration sensor 15 when the speed is being switched from the first speed to the second speed, an error t8' at the timing at which the speed of the sheet feeding motor 403 is changed to the second speed is obtained by the following Expression (5). Then, the recording material 11 is conveyed at the second speed for the time t15 obtained in accordance with the obtained t8' and Expression (3). Then, the speed is decelerated to the first speed again and the recording material 11 is made to reach the secondary transfer portion.

$$t8'=t8-((15\times t9)-t11) \quad (5)$$

Parameters in Expression (5) are:

t8: temporal error;

t9: time necessary to convey unit quantity of the recording material 11 at the first speed;

t11: time necessary since the recording material 11 is detected by the registration sensor 15 until the speed is switched to the second speed; and l5: distance necessary since the recording material 11 is detected by the registration sensor 15 until the speed is switched to the second speed.

Figure 9:
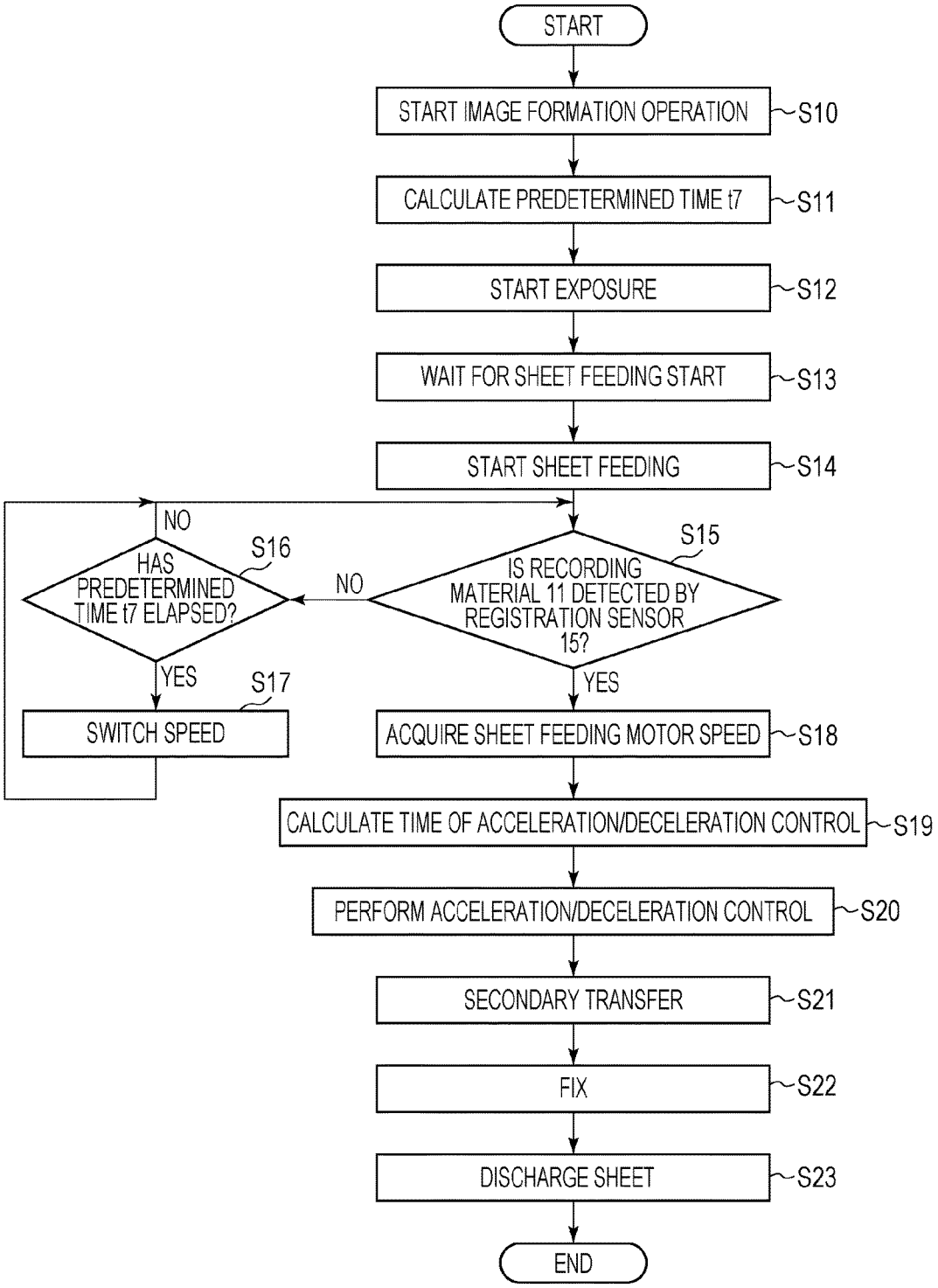
FIG. 9 is a flowchart illustrating sheet feeding control of the recording material.

FIG. 9 is flowchart illustrating sheet feeding control of the recording material 11 in the present embodiment. In S10, the CPU 400 starts image formation operation when printing start is instructed. In S11, when the image formation operation is started, the CPU 400 calculates the predetermined time t7, which is the timing at which the speed of the sheet feeding motor 403 is switched from the first speed to the second speed. In S12, the CPU 400 makes each of the photoconductive drum 3*a* to 3*d* exposed by the optical unit 5*a* to 5*d* to form an electrostatic latent image.

In S13, the CPU 400 makes sheet feeding of the recording material 11 wait until the sheet feeding start timing. In S14, when the sheet feeding start timing comes, the CPU 400 makes the sheet feeding roller 12 drive to feed the recording material 11 stacked on the paper cassette 13 at the first speed. In S15, the CPU 400 determines whether the front end of the recording material 11 in the conveyance direction is detected by the registration sensor 15. If the front end is not detected, the process proceeds to S16, and if the front end is detected, the process proceeds to S18.

If it is determined that the front end of the recording material 11 in the conveyance direction is not detected in S15, the CPU 400 determines in S16 whether the predetermined time t7 calculated in S11 has elapsed. That is, the CPU 400 determines whether timing at which the speed of the sheet feeding motor 403 is to be switched from the first speed to the second speed has come. If it is determined that the timing has come, the process proceeds to S17 and if not, the process proceeds to S15. If it is determined in S16 that the timing to switch has come, the CPU 400 switches the speed of the sheet feeding motor 403 from the first speed to the second speed in S17 before the recording material 11 is detected by the registration sensor 15.

If it is determined in S15 that the front end of the recording material 11 in the conveyance direction is detected, the CPU 400 obtains in S18 the speed of the sheet feeding motor 403 at the time of detecting the front end of the recording material 11 in the conveyance direction that is detected in S15 by the registration sensor 15. In S19, the CPU 400 obtains the error t8 in accordance with the timing at which the front end of the recording material 11 in the conveyance direction is detected by the registration sensor 15. In accordance with the error t8, the CPU 400 obtains the time for which the recording material 11 is conveyed at the second speed. In S20, the CPU 400 performs acceleration/deceleration control of the recording material 11 in accordance with the time for which the recording material 11 is conveyed at the second speed obtained in S19. In S21, the CPU 400 makes the toner image formed on the intermediate transfer belt 2 be secondarily transferred to the recording material 11 in the secondary transfer portion. In S22, the CPU 400 makes the recording material 11 to which the toner image has been transferred be heated and fixed by the fixing unit 10. In S23, the CPU 400 makes the recording material 11 to which the toner image has been fixed discharge out of the image forming apparatus.

In this manner, multi feeding of the recording material 11 can be reduced by setting the speed at which the recording material 11 is fed to the first speed, and switching the conveyance speed of the recording material 11 to the second speed when predetermined time elapses after the recording material 11 is fed. Further, since the conveyance speed of the recording material 11 is switched to the second speed when predetermined time elapses even before the recording material 11 is detected by the registration sensor 15 after the recording material 11 is fed, a sheet interval can be provided with which a subsequent sheet does not contact a preceding sheet without increasing an image interval between an image formed on the preceding sheet and an image formed on the subsequent sheet. Thus, a decrease in productivity can also be reduced. Further, by performing acceleration/deceleration control of the recording material 11 in accordance with the timing at which the recording material 11 is detected by the registration sensor 15, the toner image can be made to reach the secondary transfer portion in synchronization with the conveyance of the recording material 11.

Second Embodiment

In the present embodiment, a method for obtaining the predetermined time t7 in accordance with the operation of the clutch mechanism of the sheet feeding roller 12 is described. Description of the same configuration as that of the above first embodiment is omitted.

A method for obtaining the predetermined time t7 until the speed of the sheet feeding motor 403 is switched from the first speed to the second speed based on the sheet feeding start timing t6*e* in accordance with the operation of the clutch mechanism of the sheet feeding roller 12 is described. When the clutch mechanism is operated, the state of the sheet feeding roller 12 is switched between: a state in which driving force from the sheet feeding motor 403 is transmitted; and a state in which driving force is interrupted. In such a configuration, the predetermined time t7 can be obtained by the following Expression (6).

$$t7=t12+t13 \quad (6)$$

Parameters in Expression (6) are:

t12: time since the clutch mechanism starts the operation until the driving force is transmitted to the sheet feeding roller 12; and t13: time since the driving force is transmitted to the sheet feeding roller 12 until driving force to the sheet feeding roller 12 is interrupted.

The recording material 11 that does not reach the separation roller 21 before the predetermined time t7 obtained by Expression (6) elapses stops at a position before reaching the sheet feeding roller 12 and the separation roller 21. Such a situation is regarded as a sheet feeding conveyance jam and error processing is performed. Therefore, since it is possible to accelerate to the second speed after the recording material 11 reaches the separation roller 21 by obtaining the predetermined time t7, which is the time before the speed of the sheet feeding motor 403 is switched is obtained by Expression (6), multi feeding of the recording material 11 can be reduced.

In this manner, multi feeding of the recording material 11 can be reduced by setting the speed at which the recording material 11 is fed to the first speed, and switching the conveyance speed of the recording material 11 to the second speed when predetermined time elapses after the recording material 11 is fed. Since the conveyance speed of the recording material 11 is switched to the second speed after predetermined time, a sheet interval can be provided with which a subsequent sheet does not contact a preceding sheet without increasing an image interval between an image formed on the preceding sheet and an image formed on the subsequent sheet. Thus, a decrease in productivity can also be reduced.

Modifications

In the above embodiments, the image forming apparatus of the intermediate transfer system consisting of four photoconductive drums has been described as an example, but this configuration is not restrictive. For example, the above embodiments may be applied also to an image forming apparatus that forms a monochrome image in which sheet feeding is started before exposure is started. In the case in which glossy paper (gross paper) is used as the recording material 11, the sheet feeding speed is the first speed in the above embodiments, but this example is not restrictive. For example, the sheet feeding speed of other paper than glossy paper, such as cardboard, may be the first speed, and the sheet feeding speed of the recording material 11 of any kind may be the first speed. The kind of the recording material 11 is determined, for example, to be glossy paper based on, for example, a detection result by a medium sensor provided in the image forming apparatus, or information designated by a user through an external apparatus or a panel.

Advantageous Effects of Invention

According to the configuration of the present invention, occurrence of multi feeding when recording materials are fed can be reduced and a decrease in productivity can also be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-050800, filed Mar. 13, 2014 which is hereby incorporated by reference herein in its entirety.

What is claimed is:

1. An image forming apparatus comprising:

a feeding member configured to feed a recording material stacked on a stacking unit;

a conveying member configured to convey the recording material fed by the feeding member;

a separation member configured to separate recording materials so that one recording material is conveyed in a case where a plurality of recording materials are fed from the stacking unit by the feeding member;

a detecting unit disposed on a downstream side of the conveying member in a conveyance direction of the recording material, and configured to detect the recording material;

a controller configured to control the feeding member and the conveying member; and an image forming unit configured to form an image on the recording material conveyed by the conveying member, wherein the controller controls the feeding member to feed the recording material stacked on the stacking unit at a first speed, wherein, in a case where the detecting unit does not detect the recording material before a predetermined time has passed since the controller began controlling the feeding member to feed the recording material stacked on the stacking unit, the controller controls the conveying member to change a speed of the recording material from the first speed to a second speed that is faster than the first speed at a timing when the predetermined time has passed since the controller began controlling the feeding member to feed the recording material stacked on the stacking unit and the controller sets a length of a conveyance time to convey the recording material at the second speed based on a detection timing when the detecting unit detects the recording material, and wherein the controller sets a length of the predetermined time in such a manner that the recording material fed at the first speed reaches at least the separation member at the timing when the predetermined time has passed.

2. The image forming apparatus according to claim 1, further comprising:

a driving unit configured to drive the feeding member and the conveying member; and a transmission unit configured to transmit driving force from the driving unit to the feeding member, wherein the controller sets a length of the predetermined time based on a time from when the driving force is transmitted to the feeding member by the transmission unit to when the driving force is interrupted.

3. The image forming apparatus according to claim 1, wherein the image forming unit includes a photosensitive member on which a toner image is formed, a primary transfer unit configured to transfer the toner image formed on the photosensitive member to an intermediate transfer member, and a secondary transfer unit configured to transfer the toner image, which is transferred on the intermediate transfer member, to the recording material at a transfer portion, wherein the controller sets the length of the predetermined time based on a distance from the separation member to the transfer portion, and a conveyance speed at which the recording material is conveyed from the separation member to the transfer portion.

4. The image forming apparatus according to claim 3, wherein the controller sets the length of the predetermined time based on a shortest conveyance time for the recording material to be conveyed from the separation member to the transfer portion when the recording material is conveyed at the second speed when the recording material reaches the separation member.

5. The image forming apparatus according to claim 1, wherein, in a case where the detecting unit detects the recording material before the predetermined time has passed since the controller began controlling the feeding member to feed the recording material stacked on the stacking unit, the controller controls the conveying member to change the speed of the recording material from the first speed to a third speed that is different from the first speed at the detection timing and the controller sets the third speed and a length of a conveyance time to convey the recording material at the third speed based on the detection timing.

6. The image forming apparatus according to claim 5, wherein the controller controls the conveying member to change the speed of the recording material from the third speed to the first speed at a timing when the conveyance time to convey the recording material at the third speed has passed.

7. The image forming apparatus according to claim 1, wherein, in a case where the recording material is one of glossy paper and cardboard, and the detecting unit does not detect the recording material before the predetermined time has passed since the controller began controlling the feeding member to feed the recording material stacked on the stacking unit, the controller controls the conveying member to change the speed of the recording material from the first speed to the second speed at the timing when the predetermined time has passed since the controller began controlling the feeding member to feed the recording material stacked on the stacking unit, wherein, in a case where the recording material is not plain paper, and the detecting unit does not detect the recording material before the predetermined time has passed since the controller began controlling the feeding member to feed the recording material stacked on the stacking unit, the controller controls the conveying member to refrain from changing the speed of the recording material at the timing when the predetermined time has passed since the controller began controlling the feeding member to feed the recording material stacked on the stacking unit.

8. The image forming apparatus according to claim 1, wherein, in a case where the detection timing is a first timing, the controller sets a length of the conveyance time to a length of a first time period, and, wherein, in a case where the detection timing is later than the first timing, the controller sets the length of the conveyance time to a length of a second time period that is longer than the length of the first time period.

9. The image forming apparatus according to claim 8, wherein the controller controls the conveying member to change the speed of the recording material from the second speed to the first speed at a timing when the conveyance time has passed.

10. The image forming apparatus according to claim 9, wherein the image forming unit includes a photosensitive member on which a toner image is formed, a primary transfer unit configured to transfer the toner image formed on the photosensitive member to an intermediate transfer member, and a secondary transfer unit configured to transfer the toner image, which is transferred on the intermediate transfer member, to the recording material at a transfer portion, wherein the first speed is a speed of the recording material when the toner image is transferred to the recording material at the transfer portion, and wherein the controller sets the length of the conveyance time in such a manner that the toner image having been transferred on the intermediate transfer member is transferred onto the recording material at the transfer portion.

11. The image forming apparatus according to claim 1, wherein the conveying member conveys the recording material without the recording material being stopped in a section between the feeding member and the detection unit.

12. The image forming apparatus according to claim 1, wherein the first speed is set based on reducing an occurrence of multi feeding due to a type of recording material fed by the feeding member.

13. The image forming apparatus according to claim 1, further comprising:

a driving unit configured to drive the feeding member, the conveying member, and the separation member; and a transmission unit configured to transmit driving force from the driving unit to the feeding member.

14. A recording material feeding apparatus comprising:

a feeding member configured to feed a recording material stacked on a stacking unit;

a conveying member configured to convey the recording material fed by the feeding member;

a separation member configured to separate recording materials so that one recording material is conveyed in a case where a plurality of recording materials are fed from the stacking unit by the feeding member;

a detecting unit disposed on a downstream side of the conveying member in a conveyance direction of the recording material, and configured to detect the recording material; and a controller configured to control the feeding member and the conveying member, wherein the controller controls the feeding member to feed the recording material stacked on the stacking unit at a first speed, wherein, in a case where the detecting unit does not detect the recording material before a predetermined time has passed since the controller began controlling the feeding member to feed the recording material stacked on the stacking unit, the controller controls the conveying member to change a speed of the recording material from the first speed to a second speed that is faster than the first speed at a timing when the predetermined time has passed since the controller began controlling the feeding member to feed the recording material stacked on the stacking unit and the controller sets a length of a conveyance time to convey the recording material at the second speed based on a detection timing when the detecting unit detects the recording material, and wherein the controller sets a length of the predetermined time in such a manner that the recording material fed at the first speed reaches at least the separation member at the timing when the predetermined time has passed.

15. An image forming apparatus comprising:

a feeding member configured to feed a recording material stacked on a stacking unit;

a conveying member configured to convey the recording material fed by the feeding member;

a separation member configured to separate recording materials so that one recording material is conveyed in a case where a plurality of recording materials are fed from the stacking unit by the feeding member;

a detecting unit disposed on a downstream side of the conveying member in a conveyance direction of the recording material, and configured to detect the recording material;

a controller configured to control the feeding member and the conveying member;

an image forming unit configured to form an image on the recording material conveyed by the conveying member;

a driving unit configured to drive the feeding member and the conveying member; and a transmission unit configured to transmit driving force from the driving unit to the feeding member, wherein the controller controls the feeding member to feed the recording material stacked on the stacking unit at a first speed, wherein, in a case where the detecting unit does not detect the recording material before a predetermined time has passed since the controller began controlling the feeding member to feed the recording material stacked on the stacking unit, the controller controls the conveying member to change a speed of the recording material from the first speed to a second speed that is faster than the first speed at a timing when the predetermined time has passed since the controller began controlling the feeding member to feed the recording material stacked on the stacking unit and the controller sets a length of a conveyance time to convey the recording material at the second speed based on a detection timing when the detecting unit detects the recording material, and wherein the controller sets a length of the predetermined time based on a time from when the driving force is transmitted to the feeding member by the transmission unit to when the driving force is interrupted.

16. A recording material feeding apparatus comprising:

a feeding member configured to feed a recording material stacked on a stacking unit;

a conveying member configured to convey the recording material fed by the feeding member;

a separation member configured to separate recording materials so that one recording material is conveyed in a case where a plurality of recording materials are fed from the stacking unit by the feeding member;

a detecting unit disposed on a downstream side of the conveying member in a conveyance direction of the recording material, and configured to detect the recording material;

a controller configured to control the feeding member and the conveying member;

a driving unit configured to drive the feeding member and the conveying member; and a transmission unit configured to transmit driving force from the driving unit to the feeding member, wherein the controller controls the feeding member to feed the recording material stacked on the stacking unit at a first speed, wherein, in a case where the detecting unit does not detect the recording material before a predetermined time has passed since the controller began controlling the feeding member to feed the recording material stacked on the stacking unit, the controller controls the conveying member to change a speed of the recording material from the first speed to a second speed that is faster than the first speed at a timing when the predetermined time has passed since the controller began controlling the feeding member to feed the recording material stacked on the stacking unit and the controller sets a length of a conveyance time to convey the recording material at the second speed based on a detection timing when the detecting unit detects the recording material, and wherein the controller sets a length of the predetermined time based on a time from when the driving force is transmitted to the feeding member by the transmission unit to when the driving force is interrupted.

* * * * *